US008375901B2

(12) United States Patent
Krajowsky et al.

(10) Patent No.: US 8,375,901 B2
(45) Date of Patent: Feb. 19, 2013

(54) INTEGRAL VALVE PLATE COVER/LEAD FRAME OF A SWITCHABLE VALVE DEACTIVATING DEVICE OIL MANIFOLD ASSEMBLY

(75) Inventors: John M. Krajowsky, Palmyra, NY (US); Dominic Borraccia, Spencerport, NY (US); David M. Peers, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 517 days.

(21) Appl. No.: 12/636,150

(22) Filed: Dec. 11, 2009

(65) Prior Publication Data

US 2011/0139115 A1 Jun. 16, 2011

(51) Int. Cl.
*F02B 75/18* (2006.01)

(52) U.S. Cl. ..... 123/60.1; 123/90.16; 123/90.17; 123/198 E; 29/428

(58) Field of Classification Search ..... 123/60.1, 123/90.16, 90.15, 90.17, 90.31, 198 E; 29/428
See application file for complete search history.

(56) References Cited

U.S. PATENT DOCUMENTS 6,817,325 B2 11/2004 Dinkel et al.
7,007,641 B1 * 3/2006 Kryglowski et al. ..... 123/90.11

* cited by examiner

*Primary Examiner* — Zelalem Eshete
(74) *Attorney, Agent, or Firm* — Thomas N. Twomey

(57) ABSTRACT

A valve plate cover/lead frame unit of a lifter oil manifold assembly used in cylinder deactivation systems to direct engine oil to valve lifters including a body including a pattern of passages that in cooperation with a pattern of passages included in the valve plate form oil galleries for distributing the engine oil, an electrical connector and an electrical lead frame terminating the electrical connector integrated into the body, and a plurality of connector terminals incorporated into the body, wherein the electrical lead frame electrically connects each of the connector terminals with the electrical connector.

19 Claims, 4 Drawing Sheets

INTEGRAL VALVE PLATE COVER/LEAD FRAME OF A SWITCHABLE VALVE DEACTIVATING DEVICE OIL MANIFOLD ASSEMBLY

TECHNICAL FIELD

The present invention relates to internal combustion engines; more particularly, to devices for controlling systems in an internal combustion engine; and most particularly, to a valve plate cover with integrated lead frame of a lifter manifold assembly for variable activation and deactivation of valves in an internal combustion engine.

BACKGROUND OF THE INVENTION

In conventional prior art four-stroke internal combustion engines, the mutual angular relationships of the crankshaft and the opening and closing of the combustion valves are mechanically fixed; that is, the valves are opened and closed fully and identically with every two revolutions of the crankshaft by a camshaft rotationally driven by the crankshaft with an axis of rotation parallel to the axis of rotation of the crankshaft. In engine operation, a fuel/air mixture is drawn into each cylinder in a predetermined sequence, the mixture is ignited by the sparking plug, and the burned residue is discharged.

It is known that for much of the operating life of a multiple-cylinder engine, the load can be met by a functionally smaller engine having fewer firing cylinders, and that at times of low demand, fuel efficiency can be improved if one or more cylinders of a larger engine are withdrawn from firing service. It is known in the art to accomplish this by de-activating the valve trains leading to pre-selected cylinders (for example, one bank of intake and exhaust valves in a V-style engine) in any of various ways, such as by providing deactivating hydraulic valve lifters (DHVLs), deactivating roller finger followers (DRFFs), or deactivating hydraulic lash adjusters (DHLAs) which may be switched on and off electrically or hydraulically. (As used hereinafter, SVDD should be taken to mean generically any switchable valve deactivating device.)

It is known in the prior art to controllably distribute oil to SVDDs to operate the SVDDs via a hydraulic manifold mounted to the top of the engine block and connected to an oil riser in the engine block. Such a manifold is known in the art as a Lifter Oil Manifold Assembly (LOMA). A typical LOMA is disclosed in U.S. Pat. No. 6,817,325, issued Nov. 16, 2004, which is incorporated herein by reference.

Current technology in the automotive industry utilizes separately mounted Oil Control Valves (OCVs) in a manifold device. In the assembly of this device, all OCVs are linked and wired, to a single connector via a rigid wiring harness typically called a lead frame. Such a lead frame may be an overmolded set of wires forming a rigid harness. Rivets are typically used to attach the OCV terminals to the lead frame terminals. In other cases the OCV terminals may be welded to the lead frame terminals. In the prior art, the lead frame is a separate component in the LOMA and requires separate components and processes for attachment to a valve plate cover, which is undesirable from an economical point of view.

What is needed in the art is a LOMA that includes a decreased number of components, enables a simplified assembly process, and provides a positive connection from the OCVs to the electrical circuit.

It is a principal object of the present invention to provide a valve plate cover with an integral lead frame and an integral electrical connector and, therefore, an improved LOMA for controlling the hydraulic locking and unlocking of hydraulically-switched deactivating devices in an internal combustion engine.

It is a further object of the invention to simplify the assembly and to reduce assembly costs of an internal combustion engine having variable valve activation via a plurality of SVDDs.

SUMMARY OF THE INVENTION

Briefly described, an improved LOMA in accordance with the invention for managing pressurized oil delivered to the SVDDs includes a lead frame and an electrical connector integrated into a composite valve plate cover that is used to seal the valve plate (manifold) oil galleries thereby eliminating the lead frame and its attachment components as separate components of a typical prior art LOMA. To form the valve plate cover/lead frame unit, the wiring that connects all of the OCVs with an electrical connector is overmolded into the composite valve plate cover as is the electrical connector. The OCVs, which are plugged directly into sockets included in the valve plates, include terminals that intersect with M-slots or a similar type of electrical connections integral to the valve plate cover/lead frame unit in accordance with the invention. When the valve plate cover/lead frame unit is attached to the valve plate, as for example, by welding, the terminals of the OCVs are positively held in their mating interface integrated into the cover/lead frame unit.

By forming the valve plate cover/lead frame unit in accordance with the invention, the number of components in a LOMA is decreased and the assembly of a LOMA is simplified compared to a prior art LOMA. Furthermore, a positive electrical connection from the OCVs to the electrical circuit is enabled.

An added advantage of overmolding the wires of the lead frame integral with the valve plate cover is that the lead frame wires now provide a "torcherous path" type seal and a secondary sealant operation as needed in the assembly of a prior art LOMA to prevent oil wicking along the wires to the connector terminals and from there to the atmosphere is not necessary anymore.

BRIEF DESCRIPTION OF THE DRAWINGS

The present invention will now be described, by way of example, with reference to the accompanying drawings, in which.

Corresponding reference characters indicate corresponding parts throughout the several views. The exemplification set out herein illustrates one presently preferred embodiment of the invention, and such exemplification is not to be construed as limiting the scope of the invention in any manner.

DESCRIPTION OF THE PREFERRED EMBODIMENTS

Figure 1:
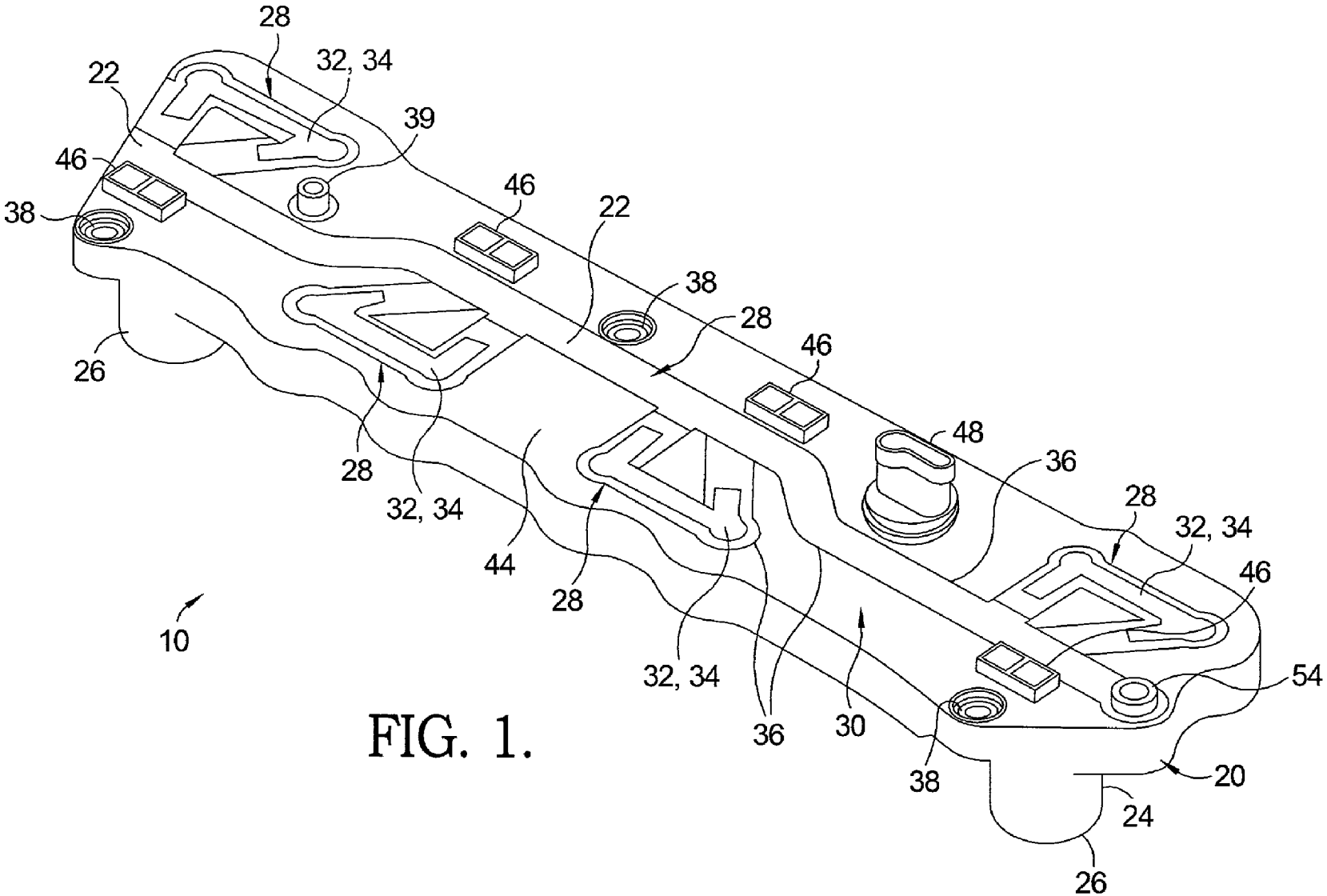
FIG. 1 is an isometric view of a valve plate assembly in accordance with the present invention.
Figure 2:
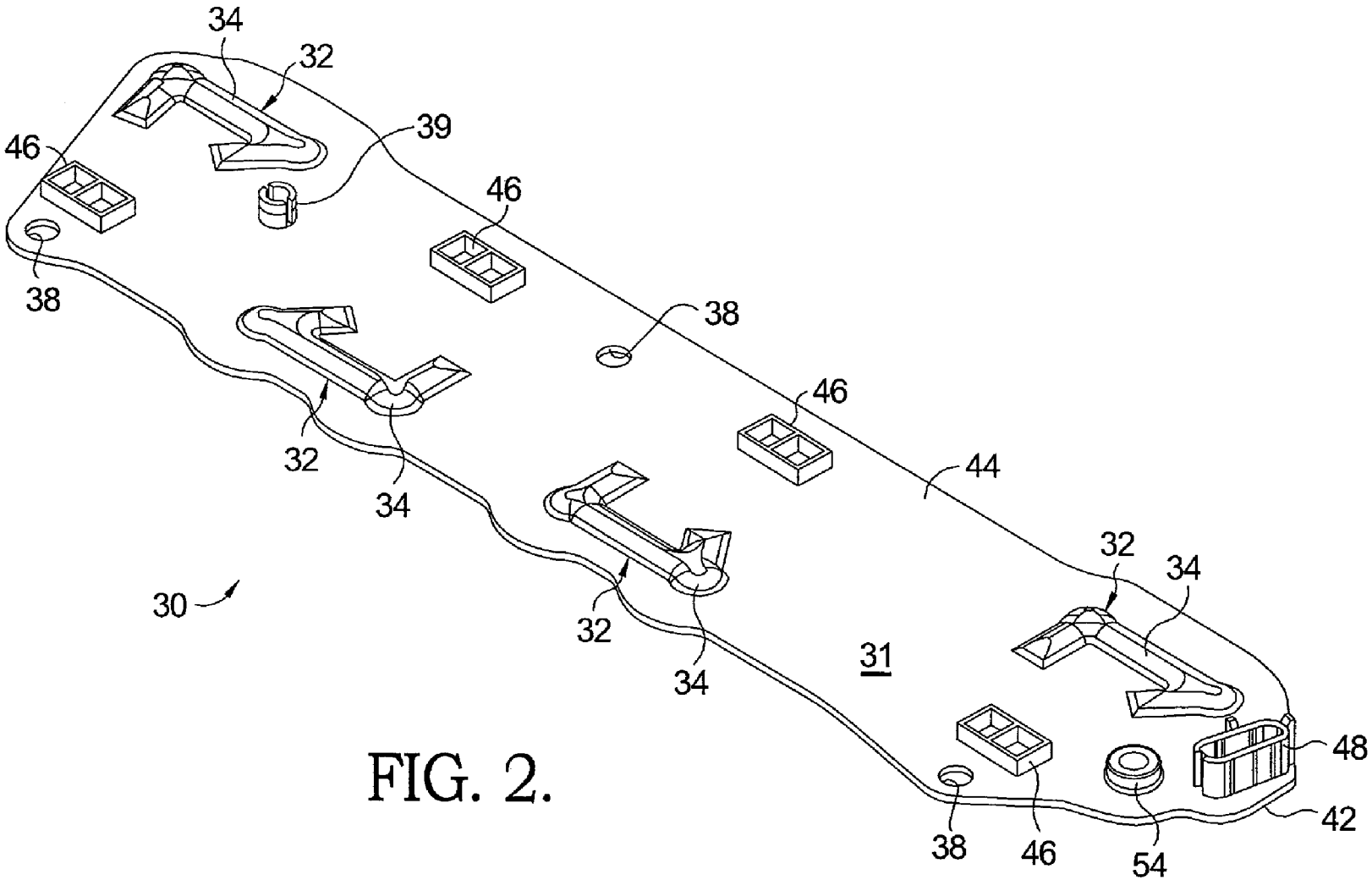
FIG. 2 is an isometric view of a valve plate cover/lead frame unit in accordance with the invention.
Figure 3:
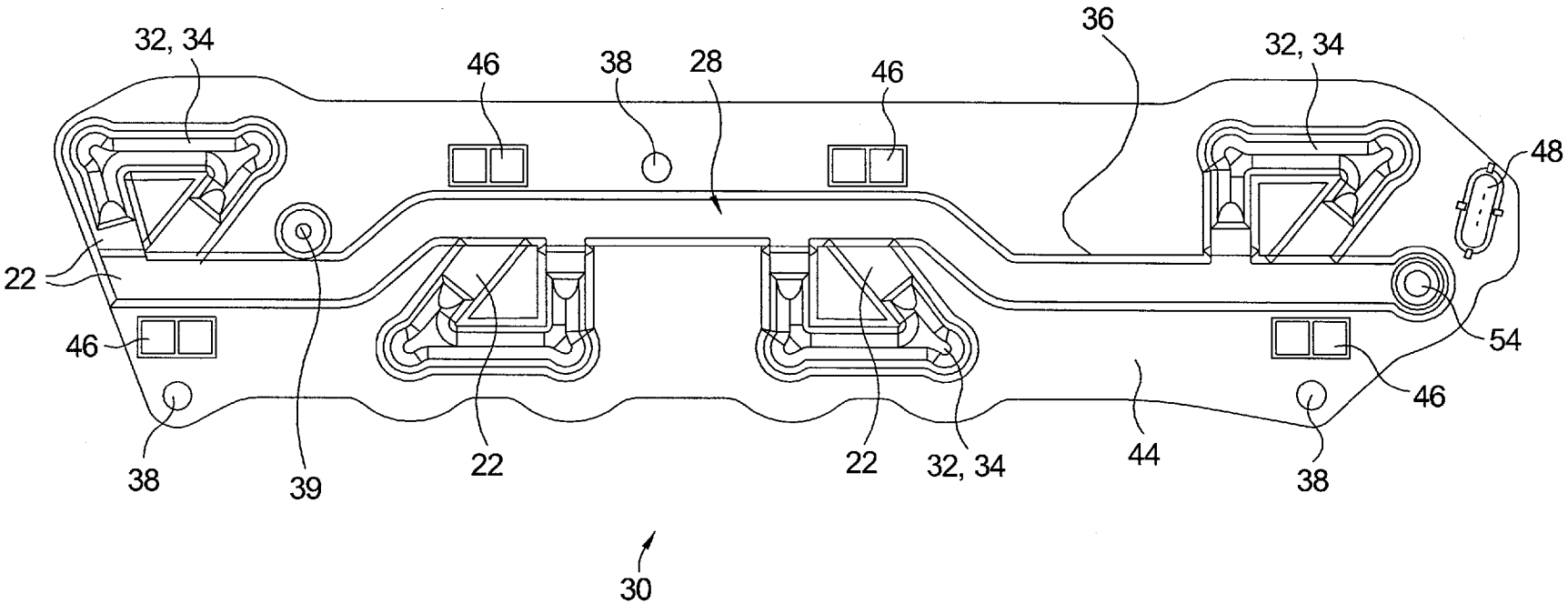
FIG. 3 is a plan view of the valve plate cover/lead frame unit shown in FIG. 2, showing the paths, in dashed lines, forming oil supply galleries.

Referring to FIGS. 1 through 3, a valve plate assembly 10 in accordance with the present invention includes a valve plate 20 and a valve plate cover/lead frame unit 30 (shown in detail in FIG. 2). Valve plate assembly 10 is part of a LOMA for controlling the hydraulic locking and unlocking of SVDDs, such for example deactivatable valve lifters, in an internal combustion engine.

A first pattern of passages 22 is formed in valve plate 20. Similarly, a second pattern of passages 32 is formed in an underside 42 of a body 31 of valve plate cover/lead frame unit 30. Passages 32 may be expressed as a corresponding pattern of raised sections 34 on the upper surface 44 of body 31 (also shown in FIG. 2). The patterns of passage 22 and 32 in valve plate 20 and cover/lead frame unit 30 cooperate to define and form the oil galleries 28 of a complex three dimensional network for selectively distributing pressurized oil from an engine oil riser (not shown). An oil inlet port 54 integrated into body 31 of cover/lead frame unit 30 is used to supply oil to oil galleries 28.

Valve plate 20 and body 31 of cover/lead frame unit 30 preferably are formed of a thermoplastic polymer having a relatively high melting temperature, for example, a glass-filled polyphthalamide (PPA) or a glass-filled nylon. Valve plate 20 and cover/lead frame unit 30 may be joined along mating surfaces preferably by fusion, such as, for example, by vibration welding or laser welding. During the welding operation, the mating surfaces liquefy, compress, and fuse in a fusion zone, forming a mechanical and hermetic seal 36 defining the oil galleries 28 in valve plate assembly 10 (as shown in FIGS. 1 and 3).

Valve plate 20 includes a plurality of sockets 24 for receiving a plurality of solenoid-actuated OCVs 26 for controlling oil flow from passages 22 and 32 to individual SVDDs (not shown) in a deactivation-equipped engine. Solenoid-activated OCVs 26 may be retained in their respective sockets 24, for example, by a separate retainer or by having individual flanges that can be thermally welded to valve plate 20. Typically, each OCV 26 controls the activation and deactivation of all SVDDs (intake and exhaust) for a given cylinder of a multi-cylinder engine via outlet ports (not visible); thus, in the typical example, four control valves 26 are required to deactivate valves for four cylinders of a bank of an eight-cylinder V-style engine. However, it is possible that a single OCV could control the operation of the SVDDs of more than one cylinder.

As shown in FIGS. 1 through 3, body 31 of valve plate cover/lead frame unit 30 further includes a plurality of clearance holes 38 and at least one mounting boss 39 for mounting valve plate assembly 10 to an engine, for example, within a valley of a V-style engine. Valve plate cover/lead frame unit 30 still further includes a plurality of connector terminals 46, such as M-slots or similar type of electrical connectors, integrated into body 31, for example by overmolding, and an electrical connector 48. Electrical connector 48 is preferably integrated into cover/lead frame unit 30 by overmolding and may be positioned at various locations on the upper surface 44 of cover/lead frame unit 30. Exemplary positions of connector 48 are shown in FIG. 1 and in FIGS. 2-4.

Figure 4:
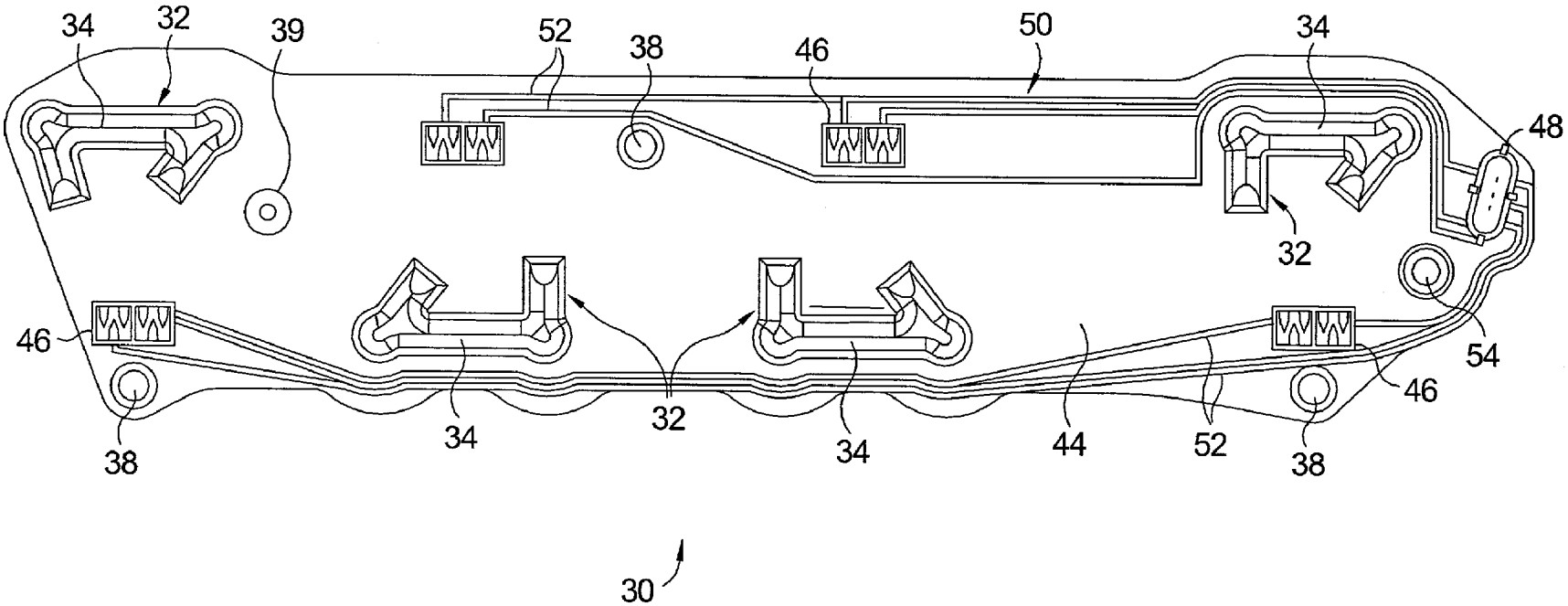
FIG. 4 is a horizontal cross-sectional view of the valve plate cover/lead frame unit shown in FIGS. 2 and 3, showing integrated lead frame wires.

Referring now to FIG. 4, an electrical lead frame 50 for supplying electrical signals from an Engine Control Module (not shown) to the solenoids of OCVs 26 is integrated into valve plate cover/lead frame unit 30 terminating electrical connector 48. Lead frame wires 52 electrically connect each connector terminal 46, such as the M-slots shown, with electrical connector 48. As can be seen in FIG. 4, lead frame wires 52 do not cross seal 36 (shown in FIGS. 1 and 3) defining the oil galleries 28. This allows lead frame wires 52 to be overmolded during the manufacture of cover/lead frame unit 30. By overmolding lead frame wires 52, a "torcherous path" type seal that prevents oil wicking along the wires 52 to connector terminals 46 and from there to the atmosphere is instantly formed around wires 52. Secondary sealing operations needed in the prior art for this purpose have been eliminated.

For each OCV 26 received by valve plate 20, one M-slot 46 or similar type of connector is integrated into cover/lead frame unit 30. When an OCV 26 is plugged into a socket 24 of valve plate 20, the terminal of the OCV 26 directly intersects with one of the M-slots 46. When cover/lead frame unit 30 is welded in place, the terminals of the OCVs 26 are held positively by the mating interface of M-slots 46.

By designing cover lead/frame unit 30 as a single integral part with integrated lead frame wires 52, an integrated electrical connector 48, and integrated M-slots 46, the number of components that form valve plate assembly 10 is decreased, assembly operations of valve plate assembly 10 is simplified, and a positive connection is provided from the OCVs 26 to the electrical circuit.

A simplified process for assembling the valve plate assembly 10 includes the insertion of compression limiters into clearance holes 38. In a following step, cover/lead frame unit 30 is welded to valve plate 20. After press-in-place gaskets (not shown) are pressed into valve plate 20 in various locations, a first leak check may be performed. In a following step, the OCVs 26 are inserted into sockets 24 integral with valve plate 20. After a second leak check, the OCVs 26 are welded in place. A cap may be attached to cover oil inlet port 54 for protection of oil galleries 28 prior to assembly of valve plate assembly 20 into a LOMA.

In addition to a reduction in components and assembly process steps, the proposed design of valve plate assembly 10, and especially of cover/lead frame unit 30, offers substantial cost reduction over a prior art LOMA design.

While the invention has been described in reference to a V-type engine, it is understood that the invention is applicable to other type engines.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A valve plate cover/lead frame unit of a lifter oil manifold assembly used to direct oil to at least one switchable valve deactivating device, comprising:

a body including a pattern of passages that in cooperation with a pattern of passages included in a valve plate form oil galleries for directing said engine oil;

an electrical connector integrated into said body;

an electrical lead frame integrated into said body terminating at said electrical connector; and a connector terminal incorporated into said body, wherein said electrical lead frame electrically connects said connector terminal with said electrical connector.

2. The valve plate cover/lead frame unit in accordance with claim 1, wherein said body is formed by molding of a thermoplastic polymer material.

3. The valve plate cover/lead frame unit in accordance with claim 1, wherein said body and said valve plate are joined along mating surfaces forming a hermetic seal along said passages defining said oil galleries.

4. The valve plate cover/lead frame unit in accordance with claim 3, wherein said electrical lead frame includes a lead frame wire, and wherein said lead frame wire is positioned within said body such that said wire does not cross said seal defining said oil galleries.

5. The valve plate cover/lead frame unit in accordance with claim 1, wherein said body further includes an oil inlet port to supply oil to said oil galleries.

6. The valve plate cover/lead frame unit in accordance with claim 1, wherein said body further includes a plurality of clearance holes and at least one mounting boss for mounting said body to an internal combustion engine.

7. The valve plate cover/lead frame unit in accordance with claim 1, wherein said electrical connector and said electrical lead frame are integrated into said body by overmolding.

8. The valve plate cover/lead frame unit in accordance with claim 1, wherein said valve plate receives at least one solenoid-operated oil control valve, and wherein a terminal of said at least one oil control valve directly intersects said connector terminal integrated into said body.

9. The valve plate cover/lead frame unit in accordance with claim 8, wherein said electrical lead frame supplies electrical signals from an engine control module to said at least one solenoid-operated oil control valve.

10. A lifter oil manifold assembly of an internal combustion engine, comprising:

a valve plate including a first pattern of passages and a plurality of sockets each of said sockets receiving an oil control valve; and a cover/lead frame unit including:

a body having a second pattern of passages, wherein said second pattern of passages cooperates with said first pattern of passages to define and form oil galleries for selectively distributing oil to said oil control valves;

an electrical lead frame integral with said body;

an electrical connector integral with said body, said electrical connector being electrically connected to said electrical lead frame; and a plurality of connector terminals integrated into said body and electrically connected with said lead frame, each of said connector terminals intersecting with a terminal of one of said oil control valves.

11. The lifter oil manifold assembly in accordance with claim 10, wherein at least one of said valve plate and said body of said cover/lead frame unit is formed from a glass-filled polyphthalamide.

12. The lifter oil manifold assembly in accordance with claim 10, wherein at least one of said valve plate and said body of said cover/lead frame unit is formed from a glass-filled nylon.

13. The lifter oil manifold assembly in accordance with claim 10, wherein said lead frame includes a plurality of wires that electrically connect each of said connector terminals with said electrical connector.

14. The lifter oil manifold assembly in accordance with claim 10, wherein said valve plate and said body of said cover/lead frame unit are joined by welding, and wherein during said welding a hermetic seal is formed that defines said oil galleries, and wherein said lead frame wires do not cross said seal.

15. The lifter oil manifold assembly in accordance with claim 10, wherein said valve plate and said body of said cover/lead frame unit are joined by laser welding.

16. The lifter oil manifold assembly in accordance with claim 10, wherein said valve plate and said body of said cover/lead frame unit are joined by vibration welding.

17. A method for assembly of a valve plate assembly used to direct oil to at least one switchable valve deactivating device of an internal combustion engine, comprising the steps of:

forming a valve plate to include a first pattern of passages and a plurality of sockets for receiving solenoid-actuated oil control valves;

forming a valve plate cover to include a second pattern of passages and to have a lead frame, an electrical connector, and a plurality of connector terminals integrated;

joining said valve plate cover to said valve plate such that said first pattern of passages and said second pattern of passages form an oil gallery, and such that a hermetic seal is formed along said first and second patterns of passages to define said oil gallery for distributing oil from an inlet port to said oil control valves; and inserting said oil control valves into said sockets such that terminals of said oil control valves are directly received by said connector terminals.

18. The method in accordance with claim 17, further including the steps of:

forming said valve plate by molding of a thermoplastic polymer composite material;

integrating said lead frame, said electrical connector and said connector terminals into said cover by overmolding with said thermoplastic polymer composite material; and connecting said connector terminals with said terminals of said oil control valves.

19. The method in accordance with claim 17, further including the step of:

performing a leak test after said joining step.

* * * * *